US009046055B2

(12) United States Patent
Mikalsen et al.

(10) Patent No.: US 9,046,055 B2
(45) Date of Patent: Jun. 2, 2015

(54) HEAT ENGINE

(75) Inventors: Rikard Mikalsen, Hamburg (DE); Anthony Paul Roskilly, Longhorshy (GB)

(73) Assignee: University of Newcastle Upon Tyne, Newcastle Upon Tyne (GB)

( * ) Notice: Subject to any disclaimer, the term of this patent is extended or adjusted under 35 U.S.C. 154(b) by 908 days.

(21) Appl. No.: 13/263,153

(22) PCT Filed: Apr. 1, 2010

(86) PCT No.: PCT/GB2010/050581

§ 371 (c)(1),
(2), (4) Date: Oct. 6, 2011

(87) PCT Pub. No.: WO2010/116172

PCT Pub. Date: Oct. 14, 2010

(65) Prior Publication Data

US 2012/0024264 A1 Feb. 2, 2012

(30) Foreign Application Priority Data

Apr. 7, 2009 (GB) ..... 0905959.3

(51) Int. Cl.
*F02G 3/02* (2006.01)
*F02G 1/02* (2006.01)

(52) U.S. Cl.
CPC ... *F02G 1/02* (2013.01); *F02G 3/02* (2013.01)

(58) Field of Classification Search
CPC ..... F02G 3/02; F02G 1/02; F02B 71/04
USPC ..... 60/39.6, 729; 123/46 R, 46 B, 46 SC, 123/46 A
See application file for complete search history.

(56) References Cited

U.S. PATENT DOCUMENTS 2,900,592 A 10/1958 Baruch
3,577,729 A 5/1971 Warren (Continued)

FOREIGN PATENT DOCUMENTS

DE 2142458 A1 8/1971
EP 0369531 A1 5/1990

(Continued)

OTHER PUBLICATIONS

Johansen, T. A., Egeland, O., Johannessen, E. A., and Kvamsdal , R. (2001), "Free-piston diesel engine dynamics and control." in Proc. American Control Conference, Arlington, Va.

(Continued)

*Primary Examiner* — Andrew Nguyen
(74) *Attorney, Agent, or Firm* — Quarles & Brady LLP

(57) ABSTRACT

A heat engine comprising compressor and expander displacement elements (210, 211) reciprocating in respective compression and expansion chambers (111, 111', 102, 102') and arranged in a linear, free piston configuration, a combustor (116) separate from the compression and expansion chambers (111, 111', 102, 102'), and a linear energy conversion device (212, 213) providing conversion of solid, liquid, or gaseous fuel into hydraulic, electric, or pneumatic energy by means of subjecting a working fluid to a thermodynamic cycle with substantially constant pressure combustion. The inlet and outlet valves of the compression chamber (102, 102') and the rate of fuel injection to the combustor (116) are actively controlled by an electronic controller to avoid engine damage, and to maintain thermodynamic efficiency over a wide range of loads.

19 Claims, 5 Drawing Sheets

(56) References Cited

U.S. PATENT DOCUMENTS

| | | | | |
|---|---|---|---|---|
| 3,600,886 | A | 8/1971 | Jaspers et al. | |
| 3,797,247 | A | 3/1974 | Schwartzman | |
| 3,937,018 | A | 2/1976 | Beale | |
| 4,008,574 | A | 2/1977 | Rein | |
| 4,044,558 | A * | 8/1977 | Benson | 60/520 |
| 4,058,382 | A | 11/1977 | Mulder | |
| 4,079,586 | A | 3/1978 | Kincaid, Jr. | |
| 4,212,163 | A | 7/1980 | Mikina | |
| 4,642,988 | A | 2/1987 | Benson | |
| 5,172,784 | A | 12/1992 | Varela, Jr. | |
| 6,412,273 | B1 | 7/2002 | Rohs | |
| 6,582,204 | B2 * | 6/2003 | Gray, Jr. | 417/364 |
| 7,318,506 | B1 | 1/2008 | Meic | |
| 2008/0271711 | A1 * | 11/2008 | Cheeseman | 123/46 E |

FOREIGN PATENT DOCUMENTS

| | | | |
|---|---|---|---|
| EP | 0810356 | A1 | 3/1997 |
| EP | 1408224 | A1 | 4/2004 |
| GB | 502 758 | A | 3/1939 |
| JP | 2153267 | A | 6/1990 |
| RU | 2340783 | C1 | 8/2007 |
| SU | 1048149 | A1 | 10/1983 |
| WO | 92/02730 | A1 | 2/1992 |
| WO | 97/28362 | A1 | 8/1997 |
| WO | 0188353 | A1 | 11/2001 |

OTHER PUBLICATIONS

Johansen, T. A., Egeland, O., Johannessen, E. A., and Kvamsdal , R. (2002) , "Free-piston diesel engine timing and control—towards electronic cam- and crankshaft" IEEE Trans. Control Systems Technology 10, 177-190.

Johansen, T. A., O. Egeland, E. A. Johannessen and R. Kvamsdal (2003) Dynamics and Control of a Free-Piston Diesel Engine. Trans. ASME, vol. 125 pp. 468-474.

Moss RW, Roskilly AP, Nanda SK: "Reciprocating Joule-cycle engine for domestic CHP systems", Applied Energy vol. 80, pp. 169-185, 2005.

Bell MA, Partridge T: "Thermodynamic design of a reciprocating Joule-cycle engine", Proc. Institute of Mechanical Engineers, Journal of Power Energy vol. 217, pp. 239-246, 2003.

Search Report and Written Opinion under date of Jul. 20, 2010 in connection with PCT/GB2010/050581.

Search Report under date of Jul. 24, 2009 in connection with GB0905959.3.

Mikalsen R., Jones E., Roskilly A.P. "Predictive piston motion control in a free-piston internal combustion engine" Applied Energy, 2010; 87:1722-1728.

* cited by examiner

HEAT ENGINE

CROSS-REFERENCE TO RELATED APPLICATIONS

This application claims priority to PCT International Application No. PCT/GB2010/050581 filed on Apr. 01, 2010, which claims priority to Great Britain Application No. 0905959.3 filed on Apr. 07, 2009, both of which are fully incorporated by reference herein.

The present invention relates to a heat engine.

Efficient conversion of heat into mechanical work has concerned researchers and engineers for more than a century, and recent years have seen an increasing focus on pollutant emissions from power generation. While internal combustion engines in many cases provide superior fuel conversion efficiencies, external combustion engines have unrivalled performance with respect to exhaust gas emissions levels, mainly due to significantly lower combustion temperatures. Exhaust gas components commonly accepted to pose human health risks, such as nitrogen oxides, carbon monoxide, and particulate matter, are increasingly being regulated by governments worldwide, particularly in densely populated areas. An external combustion engine with a fuel efficiency competitive to that of the internal combustion engine would have significant appeal due to the environmental benefits which could be realised.

Warren (U.S. Pat. No. 3,577,729) described a heat engine operating according to the Joule (also known as Brayton) thermodynamic cycle, that is, with essentially constant pressure combustion. The engine has similarities in operation to a conventional gas turbine, howeveruses reciprocating piston-cylinder arrangements for the compressor and expander units. The use of reciprocating machinery for these components improves compression and expansion efficiencies compared with the rotodynamic machinery used in gas turbine engines, however this also dramatically reduces system power to weight ratio. This "reciprocating Joule cycle engine concept" was discussed by Bell and Partridge (Bell M A; Partridge T. Thermodynamic design of a reciprocating Joule-cycle engine. Proc. Institution of Mechanical Engineers: Journal of Power Energy vol. 217, pages 239-246, 2003) and Moss et al. (Moss R W; Roskilly A P; Nanda S K. Reciprocating Joule-cycle engine for domestic CHP systems. Applied Energy vol. 80, pages 169-185, 2005), who demonstrated the engine's potential for high fuel efficiency. These reports also showed a high sensitivity to frictional losses and advised that great care must be taken in the design of the engine in order to minimise mechanical friction.

Benson (U.S. Pat. No. 4,044,558) described a closed cycle reciprocating Joule cycle engine using a linear, free-piston engine configuration and a linear load. This configuration is more compact than a crankshaft engine, and significantly reduces frictional losses in the system through utilising the linear power output directly. The use of a closed cycle gives flexibility in the choice of working fluid, benefiting system performance and increasing lifetime. However, a closed cycle engine requires a heat exchanger for transferring heat from an external source to the working fluid. Materials properties in the heat exchanger limit the permitted maximum cycle temperature in closed cycle engines, which limits the cycle efficiency that can be achieved. The use of an open cycle, as that proposed by Warren, in the system described by Benson appears desirable to improve fuel efficiency, but is associated with a number of challenges.

The free-piston engine principle is described extensively in the literature. The main challenge with free-piston machinery is well documented: due to the absence of a crankshaft mechanism, as that known from conventional engines, other means of controlling piston motion is required. Highly accurate control is required in order to avoid stroke lengths that can lead to mechanical contact between the piston and the cylinder head ("over-stroke"), which may cause catastrophic damage to the engine. At the same time, a low cylinder clearance volume is required to achieve efficient compression and expansion with high volumetric efficiencies, to maintain high engine efficiency. Moreover, the powering and control of engine accessories, such as valves, fuel injection, cooling pump, and lubrication pumps must be resolved by alternative means in a free-piston engine. In a conventional engine, rotating pumps can readily be driven by the crankshaft, and the timing of valves and fuel injection can be controlled by the crank position. The free-piston engine does not have a rotating power output or the positional reference that the crank angle offers, and, moreover, the piston stroke length is not fixed.

A further potential challenge in the reciprocating Joule cycle engine is the pulsating nature of the flow through the combustion chamber, which is a result of the reciprocating compression and expansion devices. In order to ensure efficient combustion, low emissions formation, and combustion stability, one may need to vary the rate of fuel injection according to the working fluid flow. In a crankshaft engine, it is relatively straight-forward mechanically to implement pulsating fuel injection to increase fuel flow subsequent to the compressor cylinder discharge, since both these components are controlled by crankshaft position and no timing difficulties will occur. In the free-piston engine, an alternative method must be developed.

The present invention relates to a highly efficient engine concept for the conversion of energy from solid, liquid, or gaseous fuels into electric, hydraulic, or pneumatic energy. It is intended for use in applications such as electric power generation, combined heat and power systems, propulsion systems, and other applications in which conventional combustion engines are presently used.

According to the present invention, there is provided a heat engine comprising: a compression chamber; a first positive displacement element reciprocable within said compression chamber; an expansion chamber; a second positive displacement element reciprocable within said expansion chamber; wherein said first and second positive displacement elements are mechanically coupled to reciprocate in unison in a free-piston configuration; conduit means for conducting said working fluid from said compression chamber to said expansion chamber; heating means for supplying heat to a working fluid in a heating section of said conduit means; first valve means for controlling the flow of said working fluid into said compression chamber; second valve means for controlling the flow of said working fluid from said compression chamber to said heating section; third valve means for controlling the flow of working fluid from said heating section to said expansion chamber; fourth valve means for controlling the flow of said working fluid out of said expansion chamber; a sensor adapted to output a signal corresponding to a position and/or velocity of the first/second positive displacement element; and a controller for continuously controlling the third and/or fourth valve means and/or the rate of supply of heat to the working fluid in accordance with the signal output by the sensor.

By providing a sensor adapted to output a signal corresponding to a position and/or velocity of the first/second positive displacement element, and a controller for variably controlling the third and/or fourth valve means and/or the rate of supply of heat to the working fluid in accordance with the signal output by the sensor, the engine is able to achieve higher fuel efficiency, enhanced control of the displacement elements, and greater operational flexibility, in particular greater adaptability to load variations. The sensor signal can be used to identify a danger of over-stroke or engine stalling, or fluctuations in operating conditions. Accordingly, the controller allows accurate control of valve timings and/or rate of heat supply, thereby maintaining high fuel efficiency for a wide range of loads, allowing its use in applications with rapidly changing load demands, and avoiding stalling or engine damage.

Preferably, the heat engine operates on an open cycle.

Using an open cycle enables a higher engine cycle efficiency to be achieved. When a closed cycle is used, a heat exchanger is required to transfer heat to the working fluid, and materials properties of the heat exchanger limit the maximum cycle temperature. Using an open cycle, higher temperatures can be used, increasing the fuel efficiency of the engine. In an open cycle system, fuel can be injected directly into the working fluid, offering much faster heat transfer and therefore better control and adaptability of the engine to changing conditions. The enhanced controllability resulting from the use of an open cycle constitutes a major advantage of this engine over the prior art.

Preferably, the heating means is a combustor.

Preferably, the controller is adapted to continuously control the supply of heat to the working fluid by outputting a signal for continuously controlling a rate of fuel injection to the combustor.

Advantageously, this allows the rate of supply of heat to the working fluid to be changed rapidly, enabling rapid response of the engine to load changes. Load changes are identified from unexpected changes in the velocity of the displacement elements monitored by the sensor. The controller adapts the rate of fuel injection to the combustor in response to such changes, thereby maintaining efficient engine operation. Furthermore, this feature advantageously provides a means for controlling the rate of supply of heat to the working fluid to compensate the pulsating nature of the flow of the working fluid through the combustion chamber.

In one embodiment, the controller controls the first, second, third and fourth valve means.

Although the first and second valve means may be controlled passively, engine control can be further enhanced by controlling all the valve means using the controller.

The second displacement member may divide the expansion chamber into two expansion subchambers, the third valve means being adapted to control the flow of working fluid alternately to each expansion subchamber.

Advantageously, configuring the second displacement element as a double-acting piston in this manner improves the efficiency of the engine.

The first displacement member may divide the compression chamber into two compression subchambers, the first valve means being adapted to control the flow of working fluid alternately to each compression subchamber.

The heat engine may further comprise an energy conversion device comprising at least one reciprocable element coupled for reciprocation with said first and second displacement members.

Advantageously, this enables the reciprocating motion of the displacement members to be converted to electrical, hydraulic or pneumatic energy for example.

The energy conversion device may be positioned between the compression chamber and the expansion chamber.

Advantageously, positioning the energy conversion device between the compression and expansion chambers means that the mechanical coupling between the first and second displacement members is only required to extend through one end of the compression and expansion chambers, minimising system friction and leakage.

The heat engine may further comprise a heat exchanger for transferring heat from working fluid conducted from the expansion chamber to working fluid conducted from the compression chamber.

Advantageously, the inclusion of a regenerative heat exchanger or recuperator causes the efficiency of the engine to peak at a significantly lower pressure ratio.

Preferably, the controller is adapted to adjust the timings of opening and/or closing the third and/or fourth means and/or to adjust the rate of input of heat to the working fluid to maintain stable engine operation when the signal output by the sensor indicates a change in kinetic energy of the first/second displacement member corresponding to a change in load force on the first/second displacement member.

In this way, the engine is advantageously adapted to a wider range of loads, and to changing loads.

In one embodiment, the controller is adapted to advance closure of the fourth valve means and to delay the opening of the third valve means, when the signal output by the sensor indicates an increase in kinetic energy of the first/second displacement element sufficient for the second displacement member to travel past a predefined end point.

Advantageously, this avoids engine damage due to over-stroke of the displacement elements.

In one embodiment, the controller is adapted to delay closure of the third valve means, when the signal output by the sensor indicates a decrease in kinetic energy of the first/second displacement element sufficient for the second displacement member to fail to reach a predefined end point.

Advantageously, this reduces the likelihood of engine stalling due to a sudden load change on the displacement elements.

A preferred embodiment of the present invention will now be described, by way of example only and not in any limitative sense, with reference to the accompanying drawing, in which.

Figure 3A:
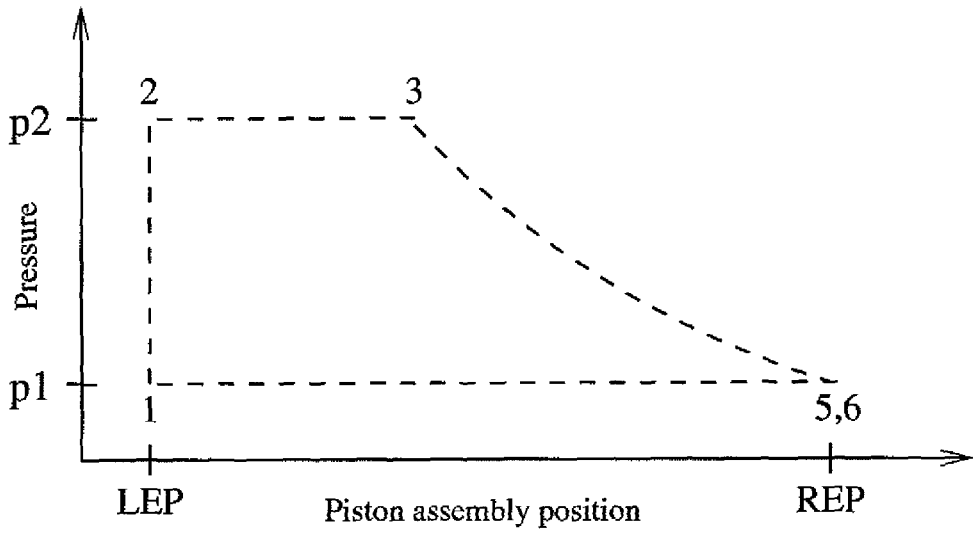
Figure 3B:
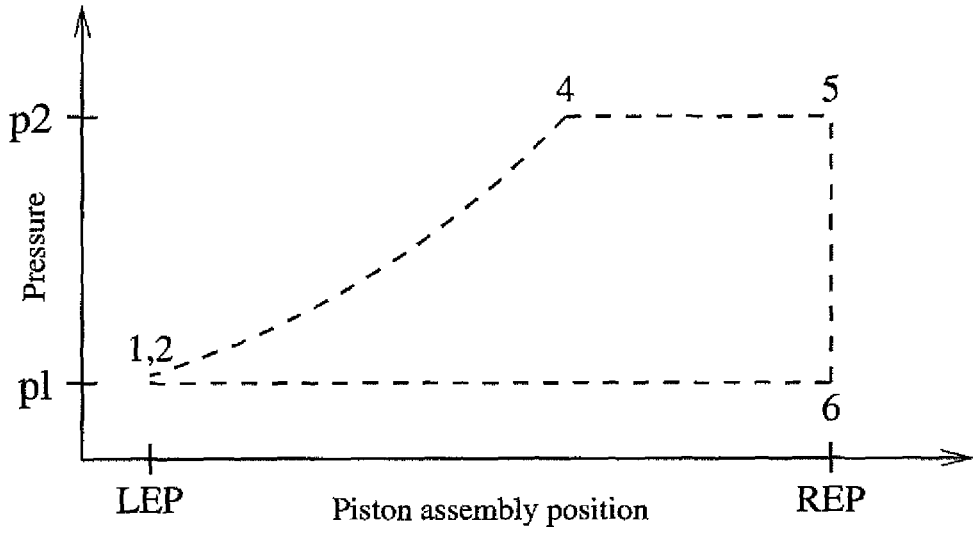
Figure 4A:
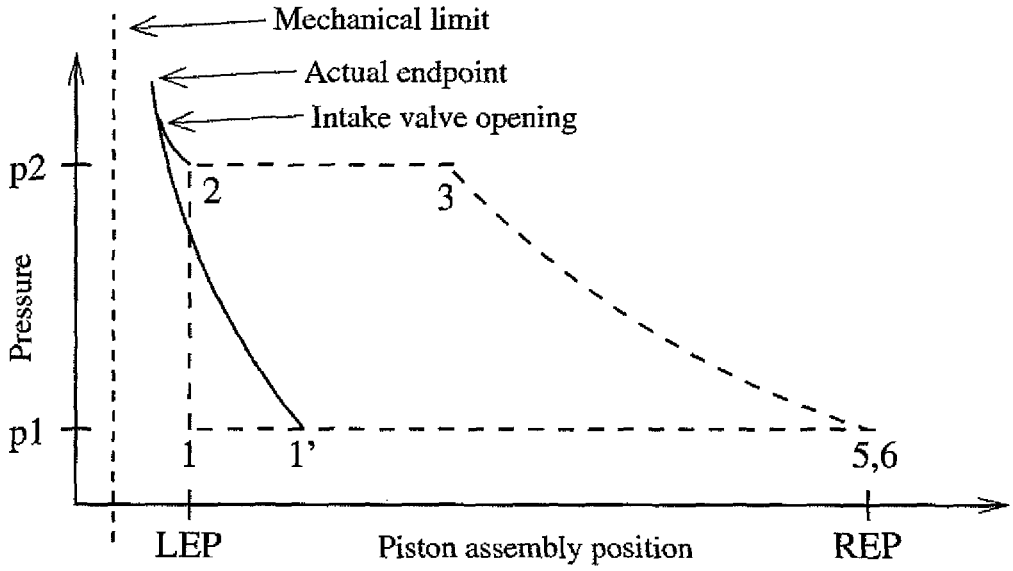
Figure 4B:
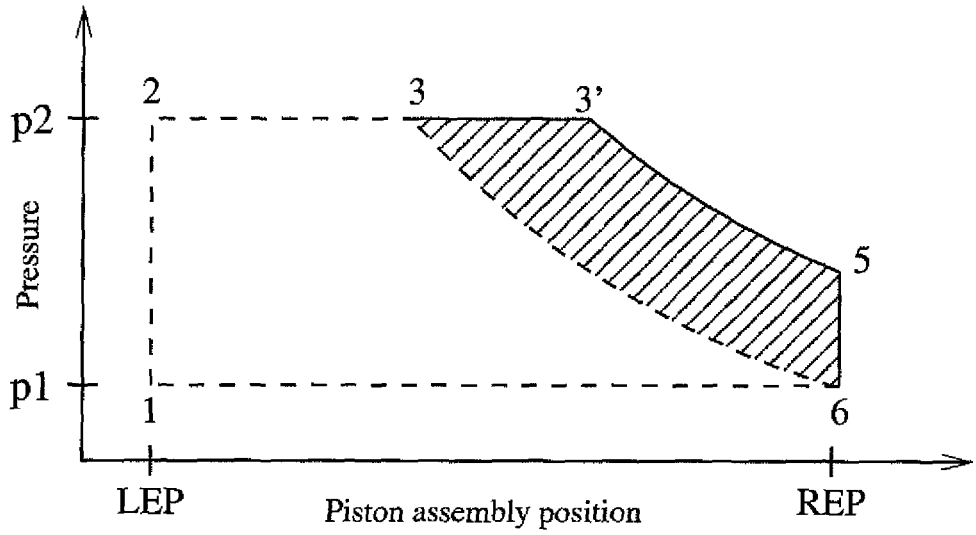
Figure 5A:
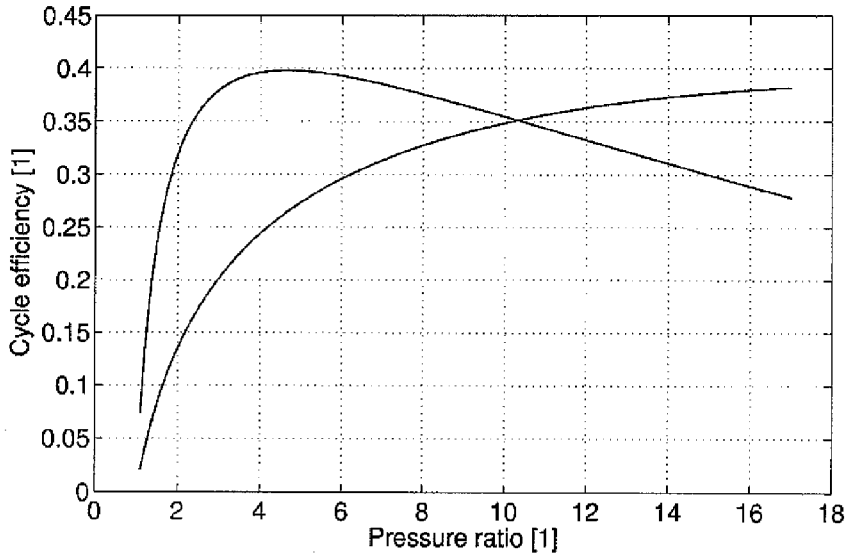
Figure 5B:
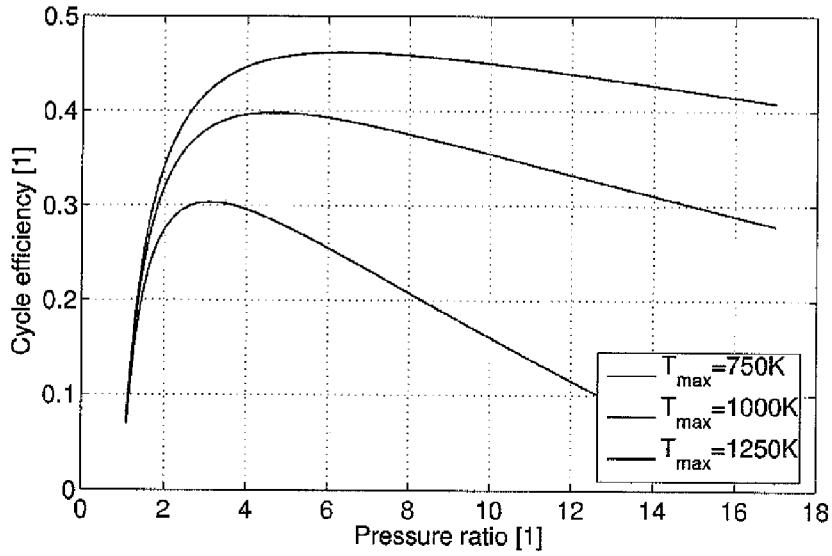

FIGS. 3*a* and 3*b* illustrate the fluid pressures in two cylinder chambers during one full cycle of engine operation;

FIGS. 4*a* and 4*b* illustrate the use of engine valve controls to achieve piston motion control during transient operation; and FIGS. 5*a* and 5*b* show the influence of some main engine design variables and can be used as a design guideline.

Figure 1:
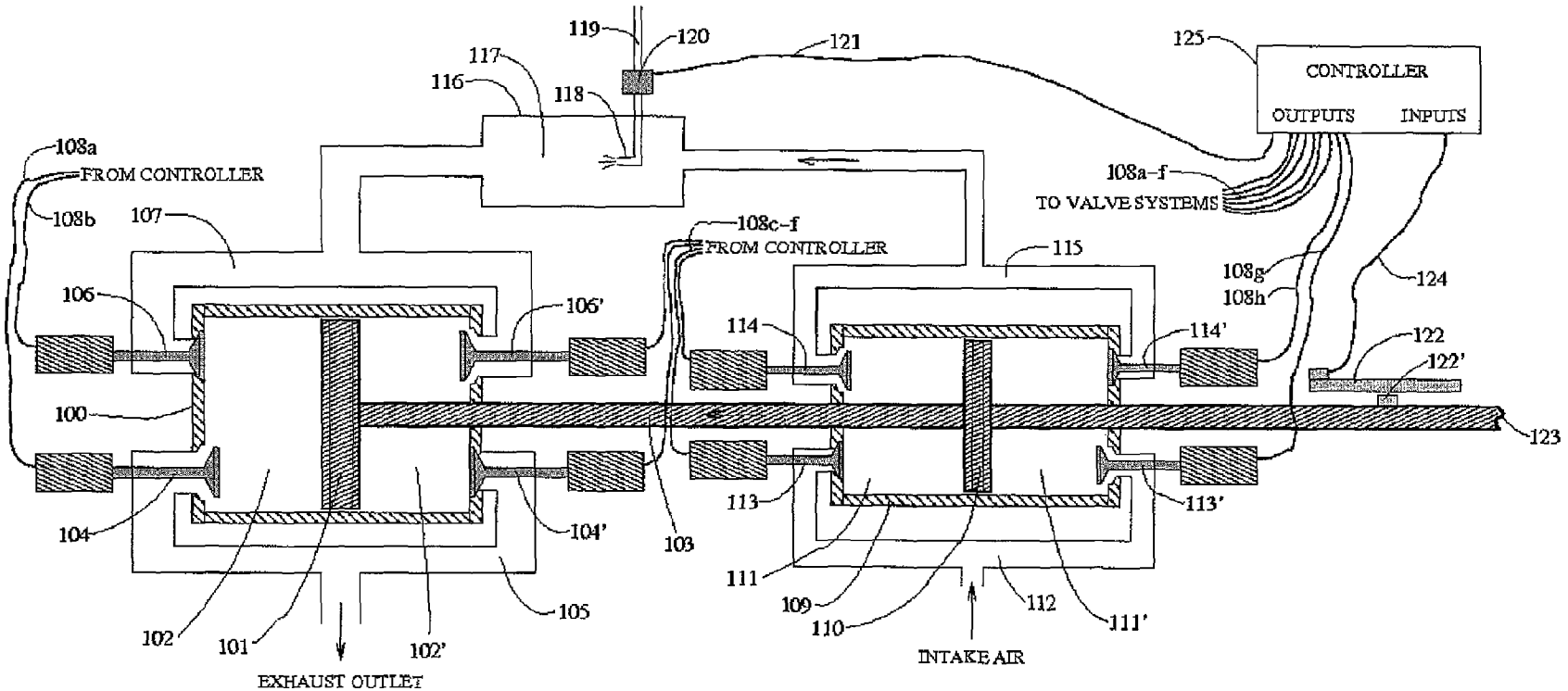
FIG. 1 shows one embodiment of the invention, illustrating its main components and a suitable configuration.

FIG. 1 shows a heat engine system according to a first embodiment of the invention. The system operates on an external combustion cycle with essentially constant pressure combustion, similar to that of conventional gas turbine engines. The compression and expansion devices consist of double-acting reciprocating cylinders arranged in a linear, free-piston configuration, and load is extracted using a linear-acting load device such as a linear electric generator or a hydraulic cylinder. An electronic controller is used to control the opening and closing of cylinder valves, as well as the rate of fuel injection.

The system consists of an expansion cylinder 100 with a reciprocable piston 101 therein. The piston 101 provides sealing against the walls of cylinder 100 through accurate machining or with the use of piston rings as is common in conventional engines, and divides the cylinder 100 into two working chambers 102 and 102'. The piston 101 is fixed to a rod 103, and the rod 103 extends through one or both ends of cylinder 100, preferably supported by a bushing with appropriate sealing. Lubrication of the surfaces inside the cylinder 100 should be provided through the injection of lubricating oil, as known from conventional engines, or with the addition of a lubricating layer on the surface during manufacturing (also known as solid film lubrication). On each end of the cylinder 100, a valve system 104 or 104' provides control of a flow connection between the respective working chambers 102 or 102' and an exhaust channel 105. Similarly, on each end of the cylinder, a valve system 106 or 106' provides control of a flow connection between the respective working chamber 102 or 102' and a combustion products channel 107. The valve systems 104, 104', 106 and 106' are in FIG. 1 illustrated as having conventional poppet-type valves, however they can be of any type suitable for operation at high temperature, such as rotating or sliding valves. The valve systems 104, 104', 106 and 106' incorporate actuators which drive the opening and closing of the connection between working chambers 102 and 102' and combustion products channel 107 and exhaust channel 105 by means of electric, hydraulic, or pneumatic energy. Preferably, electro-magnetic valve actuators should be employed. The operation of valve systems 104, 104', 106 and 106' is electronically controlled and the required position of each valve at any time (open or close) is transmitted by control signals 108*a-d*.

The system further incorporates a compression cylinder 109 with a reciprocable piston 110 therein, dividing the cylinder 109 into two working chambers 111 and 111'. The rod 103 extends through one or both ends of cylinder 109, and is fixed to the piston 110. Lubrication of the in-cylinder surface of cylinder 109 and sealing between the piston 110 and the cylinder 109 are provided similarly as described above. On each end of cylinder 109, a valve system 113 or 113' connects the respective working chamber 111 or 111' to an intake air channel 112, and a valve system 114 or 114' connects the respective working chamber 111 or 111' to a compressed air channel 115. The operation of the valve systems 113, 113', 114 and 114' is similar to that described above, but with the opening and closing of the valve systems being controlled by control signals 108*e-h*.

Connecting the compressed air channel 115 and the combustion products channel 107 is a combustor 116. The combustor 116 is assumed to have a design similar to those combustors used in conventional gas turbine engines. The combustor incorporates a combustion chamber 117, a fuel injector 118, and internal means for igniting a combustible mixture. Fuel is supplied through a fuel line 119 which has an electronically controllable valve 120 for control of the fuel flow rate to the injector 118. The electronic control signal for the valve 120 is supplied by a control signal 121.

A position sensor consists of a stationary part 122 and a non-stationary part 122'. Fixed to the rod 103 is the non-stationary position sensor part 122'. The stationary position sensor 122 records the position of the non-stationary part 122' and generates a position sensor signal 124 which identifies the position of the rod 103 at any time. The sensor may be a Hall effect sensor, although the skilled person will appreciate that other types of sensor may be used. The rod 103 further has a load connection 123, to which a linear-acting load can be coupled. The load can be of any type, such as a linear electric machine, a hydraulic, pump, or a pneumatic compressor. An electronic controller 125 receives the position signal 124 and, based on the instantaneous and previous values of this signal, generates valve signals 108*a-f* and fuel injection signal 121, thereby controlling the opening and closing of the cylinder valves and the fuel flow rate.

Through the use of an open cycle with infinitely variable valve timings and accurate control of fuel injection rate, high fuel efficiency and operational flexibility can be realised. The linear engine configuration gives inherently low system frictional losses as well as a compact system with high power to weight ratio.

Accurate valve control combined with the direct control of the heat flow rate through fuel injection control also gives significantly enhanced mechanical control of the engine. The challenges associated with piston motion control are resolved by identifying a danger of over-stroke using a piston position sensor and an electronic controller to adjust valve timing accordingly, to eliminate any risk of engine damage. This also gives the system superior response to changes in operating conditions, allowing use in applications with rapidly changing load demands, in which prior art systems would be unsuitable. The enhanced controllability resulting from the use of an open cycle constitutes a major advantage of the proposed system over prior art.

Figure 2:
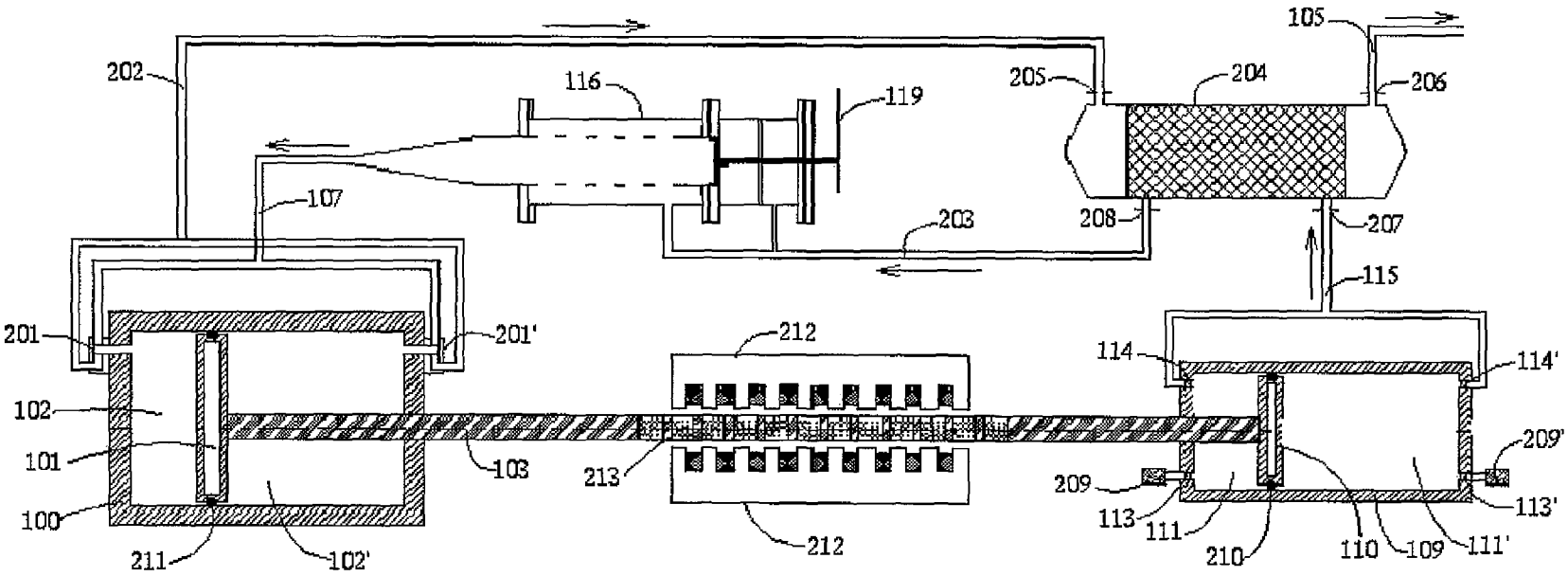
FIG. 2 shows an alternative embodiment utilising a regenerative heat exchanger for improved cycle efficiency and an alternative system configuration.

FIG. 2 shows an alternative embodiment of the system. In addition to those components described above, the embodiment shown in FIG. 2 incorporates a regenerative heat exchanger 204 (also known as a recuperator), air intake filters 209 and 209', and a linear electric machine load device 212 and 213. For clarity, the control system has been omitted and the valve systems have been simplified in the figure. The direction of fluid flow through the engine is indicated by the arrows. The valve systems 104 and 106 (see FIG. 1) is replaced with a three-way valve system 201 and the valve systems 104' and 106' is replaced with a three-way valve system 201'. Each valve system 201 or 201' is electronically controlled and includes an actuator, and can be commanded in one of three positions: closed, in which no flow through the valve is permitted; intake, in which fluid can only flow between combustion products channel 107 and the respective working chamber 102 or 102'; and exhaust, in which fluid can only flow between the respective working chamber 102 or 102' and the flow channel 202. The expansion cylinder piston 101 is fitted with piston rings 211, of conventional design, in order to minimise leakage between chambers 102 and 102'.

The intake air channel 112 (see FIG. 1) is replaced with two separate intake ducts 209 and 209' which include intake air filters. This allows atmospheric air to be used directly in the engine without the risk of any impurities entering the system, similarly to conventional combustion engines. The valve systems 113, 113', 114, and 114' consist in this embodiment of passive, one-way valves, that is, their opening and closing are controlled by the instantaneous pressure difference across the individual valves. (Such valves are also known as check valves or non-return valves.) The settings of one-way valves 113, 113', 114, and 114' should be such that, as the compression cylinder piston 110 reciprocates, atmospheric air is pumped into the compressed air channel 115.

The recuperator 204 works as a conventional heat exchanger, i.e. having two flow passages separated by a thin wall of large surface area, allowing heat to be transferred between fluids in the two passages. The recuperator 204 is positioned such that the fluid in flow channel 202 is led through the first passage through inlet 205 and exhausted to the exhaust channel 105 through outlet 206. Similarly, fluid in compressed air channel 115 is permitted to enter the second recuperator passage through inlet 207 and is exhausted to flow channel 203 through outlet 208. The flow channel 203 is connected to combustor 116 and the combustor outlet is connected to combustion products channel 107, similarly as described above.

The embodiment illustrated in FIG. 2 includes a linear electric generator acting as the load, comprising a stationary part 212 (the stator) and a moving part 213 (the translator). The electric machine is of conventional design, using coils positioned in the stator and permanent magnets positioned in the translator. In the embodiment shown, the translator 213 is embedded into the rod 103 to minimise system overall weight and size. For the same reason, in the embodiment illustrated in FIG. 2 the load device is positioned between the compression and expansion cylinders. Using this configuration, the rod 103 is only required to extend through one end of compression cylinder 109 and expansion cylinder 100, minimising system friction and leakage.

Basic System Operation

Referring to FIG. 1, the operation of the engine can be described as follows. The piston assembly consists of rod 103, expansion cylinder piston 101, compression cylinder piston 110, and position sensor 122'. The piston assembly attains a linear, reciprocating motion, driven by the net force which at any time is acting on it and constrained by the design of the expansion cylinder 100, compression cylinder 109, and load device coupled to load connection 123. Assume that the piston assembly is moving towards the left hand side (LHS), as the arrow indicates. Atmospheric air is admitted to the intake air channel 112 and from that channel to compression cylinder chamber 111' through valve system 113' which is in the "open" position. Air in compression cylinder chamber 111 is being compressed and, at some point during the right-to-left stroke, valve system 114 is commanded open and the compressed air is discharged from chamber 111 into compressed air channel 115.

During operation, air compressed in compression cylinder 109 flows from compressed air channel 115 to combustor 116. In combustor 116, fuel is injected by injector 118 and ignited, and high-temperature combustion products result. The combustion products flow through combustion products channel 107 to expansion cylinder 100. As the piston assembly commences its motion towards the LHS, inlet valve system 106' is open and allows combustion products from combustion products channel 107 to enter expansion cylinder chamber 102'. At some point during the stroke, inlet valve 106' closes, and the combustion products trapped in expansion cylinder chamber 102' expand down to a lower pressure level while performing work on piston 101. During the complete leftwards motion of the piston assembly, valve system 104 is open and combustion products from the previous stroke are discharged from chamber 102 to exhaust channel 105 and disposed of through the exhaust outlet.

As the piston assembly reaches its LHS endpoint, the second part of the cycle commences. Expansion cylinder valve system 104 closes and combustion products are admitted to expansion cylinder chamber 102 through opening of valve system 106. The pressure from the combustion products acting on piston 101 accelerates the piston assembly towards the RHS. At the same time, expanded combustion products from the previous stroke are discharged from expansion cylinder chamber 102' to the exhaust channel 105 through opening of valve system 104'. In compression cylinder 109 the closing of valve system 114 and opening of valve system 113 allows atmospheric air to be admitted into chamber 111, while closing of valve system 113' and subsequent opening of valve system 114' allows air admitted into chamber 111' in the previous stroke to be compressed and discharged into compressed air channel 115.

The opening and closing of the valve systems 104, 104', 106, 106', 113, 113', 114, and 114' are controlled by electronic controller 125, based on the piston assembly position signal 124.

The increase in internal energy of the working fluid due to combustion in combustor 116 subjects the working fluid to a thermodynamic cycle. The amount of energy generated by the expansion of the working fluid in cylinder 100 is larger than that required for compression in cylinder 109, which ensures continuous operation of the system and allows surplus energy to be extracted through a load device coupled to connection 123 and converted into high-level energy such as electric, hydraulic, or pneumatic energy.

The operation of the embodiment illustrated in FIG. 2 follows that described above, with the following exceptions:

As compressor cylinder piston 110 reciprocates, the opening and closing of each compressor cylinder valve system 113, 113', 114, and 114' is controlled by the instantaneous pressure difference across each valve system. The valve systems 113 and 113' are configured such that if the pressure in the associated chamber 111 or 111' is lower than the pressure in the respective intake duct 209 or 209', the valve is open; otherwise the valve is closed. The valve systems 114 and 114' are configured such that if the pressure in the respective chamber 111 or 111' is higher than the pressure in compressed air channel 115, the valve is open; otherwise the valve is closed.

As the piston assembly travels towards the LHS endpoint, three-way valve 201 is set such that the expanded combustion products can be discharged from chamber 102 to channel 202. As the piston assembly reaches its LHS endpoint, three-way valve 201 switches to the "intake" setting so that fluid is allowed to flow from combustion products channel 107 into chamber 102. At some point during the motion of the piston assembly towards the RHS endpoint, three-way valve 201 closes and the fluid in chamber 102 expands down to a lower pressure level. Three-way valve 201' operates similarly as valve 201 during the piston motion in the opposite direction.

As the expanded combustion products are discharged from expansion cylinder 100, they are led through channel 202 to the first passage of the recuperator 204 before being discharged from the recuperator outlet 206 to exhaust channel 105. As the compressed air is discharged from compression cylinder 109 to the compressed air channel 115, it is led through the second passage of recuperator 204 before being supplied to the combustor 116 through channel 203. In recuperator 204, heat is transferred from the expanded combustion products to the compressed air.

FIG. 3 illustrates the pressure in expansion cylinder chamber 102 and compression cylinder chamber 111' over one full engine cycle. The pressure in chambers 102' and 111 will be the mirror images of the plots shown in FIG. 3. The pressure p1 denote the fluid pressure in the low-pressure side, which includes exhaust channel 105 and intake air channel 112. The pressure p2 denote the pressure in the high-pressure side, which includes compressed air channel 115, combustor 116, and combustion products channel 107, as well as channels 202 and 203 for a configuration as shown in FIG. 2.

Assume that the piston assembly starts at the left-hand endpoint (LEP), at point 1 in the figure. At this point, valve 106 opens and the pressure in chamber 102 (shown in FIG. 3*a*) becomes equal to p2. As the piston assembly moves towards the right-hand endpoint (REP), combustion products from channel 107 is admitted into chamber 102 at pressure p2 until valve 106 closes at point 3. Thereafter, the pressure in chamber 102 drops as the fluid inside the chamber is expanded, and reaches a pressure equal to pl at REP (point 5).

Compression cylinder chamber 111' (FIG. 3*b*) is closed at LEP and, as the piston assembly moves towards REP, the fluid in chamber 111' is compressed and the pressure increases. As the pressure reaches p2, at point 4, valve 114' opens and compressed fluid is discharged into compressed air channel 115. At REP, valve 114' closes (point 5) and valves 113' and 104 open (point 6). During the return stroke from REP to LEP, expanded combustion products in chamber 102 are discharged into exhaust channel 105 through valve 104, while air is admitted into chamber 111' from intake air channel 112 through valve 113'. This completes one cycle of engine operation. The opposing chambers 102' and 111 mirror this operation.

Other Operational Issues

Starting. Several methods exist for the starting of the system. A connection on rod 103 can allow the driving of the piston assembly between the endpoints using external means, until self-sustained system operation is achieved. This is equivalent to those starting systems used in conventional engines. An alternative is to inject pressurised air into the compressed air channel 115. This will start the motion of the piston assembly and, with controller 125 in operation, fuel can be injected and ignited to start the system. A third alternative is the use of the load device in motoring mode. Depending on the type of load device, stored hydraulic, pneumatic, or electric energy can be supplied to the system through appropriate load device control to drive the piston assembly until starting is achieved. In the second embodiment, shown in FIG. 2, this can be achieved using appropriate power electronics circuits to allow the electric machine 212 and 213 to operate in motoring mode. The most suitable starting method will depend on the specific design of the system and the plant in which it is employed.

Driving of accessories. Engine accessories, such as water pump, lubrication oil pump, and fuel pump, can be powered by external means, through a direct linkage from the piston assembly, or through using part of the produced energy, be it in electric, pneumatic, or hydraulic form. It is anticipated that the latter option will be preferred in most cases.

Operational optimisation. By allowing the controller to adjust the timing of the valve systems and the rate of fuel injection, the operation of the engine can be optimised for any operating condition. In particular, this relates to the "cut-off point" in the expansion cylinder, point 3 in FIG. 3*a*. Varying the cut-off point according to the load level and other operating conditions to give an expansion of the combustion products down to the exhaust channel pressure exactly maximises the extraction of energy from the combustion products and thereby the fuel efficiency of the system. Similar control can be applied for the compression cylinder, however with the use of one-way valves, as illustrated in FIG. 2, such control follows automatically. By optimising the cut-off points, the system is capable of maintaining high fuel efficiency for a wide range of loads, which has been a limitation of prior art systems.

Piston motion control. The use of an open cycle with controllable valves and fuel injection gives significantly enhanced piston motion control possibilities and resolves the widely reported problems associated with the control of free-piston engines. Due to the low inertia of the system (compared to e.g. the crank system and flywheel in a conventional engine), a load change will have a much more direct influence in a free-piston engine. A closed cycle system, such as that described by Benson (U.S. Pat. No. 4,044,558), has a slow response to load changes as the heat addition is done through heat transfer in a heat exchanger, an inherently slow process. Hence, for a rapidly changing load, there is a risk of the engine stalling. An open cycle system in which fuel is injected directly into the working fluid will have superior control of the heat flow to the engine and therefore a much quicker response to load changes. The system presented here is therefore better suited for applications with varying load demands.

However, since there is no large energy storage, such as the flywheel in conventional engines, severe load changes may still compromise the operational stability of the engine. Both a rapid load increase and a rapid load decrease may lead to stability problems in free-piston engines, and these situations will be discussed separately here.

In the situation of a rapid load reduction, there will be an increase in the kinetic energy of the piston assembly and a risk for over-stroke. Consider the stroke between points 6 and 1 as illustrated in FIG. 3*a*. This stroke is driven by the high-pressure combustion products admitted into chamber 102', while the expanded combustion products in chamber 102 are discharged as illustrated in the figure. If, during this stroke from REP to LEP, the load is rapidly reduced, the kinetic energy of the piston assembly will be higher than normal when approaching LEP. This may lead to over-stroke and, in the worst case, the piston hitting the cylinder head. Even the scheduled opening of valve 106 at LEP to admit high-pressure fluid into chamber 101 may not provide a sufficiently large pressure force to retard the piston assembly and avoid a critical situation.

This situation is in the invention resolved with the use of the instantaneous piston position measurements and electronically controlled valve systems. If a reduction in the load occurs, this influences the acceleration of the piston assembly. Through the position measurements, a change in velocity is detected by the controller and any risk of over-stroke is identified. If there is such a risk, the controller advances the closing of valve 104 and delays the opening of valve 106 such that chamber 102 effectively forms a gas spring when the piston assembly approaches LEP. The degree to which the valve timings are adjusted will depend on the severity of the situation. This situation is illustrated in FIG. 4*a*. A load reduction which would cause the piston assembly to reach is mechanical limit is identified between points 6 and 1'. At point 1', valve 104 is closed prematurely and the pressure in chamber 102 rises rapidly. The high pressure force contributes to retarding the piston assembly with no or only a minor over-stroke as a result. As the piston assembly velocity is reversed, intake valve 106 is opened and the next stroke continues unaffected.

Conversely, a rapid load increase may lead to the piston assembly not reaching the nominal endpoint and in the worst case the engine stalling. Such as situation is predicted similarly by the controller, based on the measured velocity of the piston assembly. Illustrated in FIG. 4*b*, a load increase is identified between points 2 and 3. In this case, the closing of valve 106 is delayed until point 3' such that the pressure in chamber 102 remains high for a longer portion of the stroke, and thereby more work is done on piston 101. (The additional work is shaded in the figure.) While this leads to a reduction in fuel efficiency since the fluid is not fully expanded at point 5, it will only occur for a few cycles and therefore have little effect on the overall efficiency of the engine. In both the load reduction and the load increase cases, as soon as steady operation is achieved after the load change, the valve timing return to those values required for optimal fuel efficiency.

Hence, in addition to providing a fuel efficiency and power density advantage over prior art systems, the invention provides a solution for accurate control of piston motion, particularly in relation to emergency braking or response to rapid load changes. This reduces the risk of engine damage or unstable operation and allows use in a significantly wider range of applications, including those with highly varying load demands.

Design Considerations

The design requirements for the valve systems and flow channels are similar to those in conventional engines: low heat transfer losses, low flow pressure losses, and a compact design. The same will apply for the combustor and regenerative heat exchanger (if used), however some additional design requirements will apply for these components. Due to the reciprocating compressor and expander, the flow characteristics of the current system will, unlike conventional gas turbine engines, be pulsating. This does not rule out the use of conventional components; Moss et al. advised that these characteristics only requires a slightly larger heat exchanger. For the combustor, the implementation of pulsating fuel injection may need to be considered, depending on the volume of the flow channels between the combustor and cylinders; a large flow volume will reduce pressure oscillations and permit the use of a conventional combustor.

The main design considerations are the volume of the compressor and expander cylinders, and the maximum cycle temperature, that is in practice the fluid temperature at the combustor exit. These variables will determine the system pressure ratio, i.e. the ratio between the pressures on the high-pressure and low-pressure sides, and the cycle thermal efficiency.

FIG. 5*a* shows the influence of the pressure ratio on cycle efficiency for the first embodiment, as shown in FIG. 1, and the second embodiment, as shown in FIG. 2. The use of a recuperator gives a peak efficiency value at a significantly lower pressure ratio compared to the "simple cycle" without the regenerative heat exchanger. Bell and Partridge recommended a ratio of volumes between the expansion cylinder and compression cylinder of around 3 to achieve optimal efficiency in the recuperated system.

As is known from standard thermodynamic cycle analyses, a high maximum cycle temperature improves thermal efficiency. The permitted maximum cycle temperature in the system is limited by the materials properties in the combustion products channel, expansion cylinder valve systems, and expansion cylinder. It is recommended that materials suitable for high-temperature operation be used in these components. FIG. 5*b* illustrates the theoretical cycle efficiency (i.e. not considering mechanical or gas flow losses) for maximum cycle temperatures of 750K, 1000K, and 1250K. Temperatures of above 1000K should in most cases be permitted with the use of standard metallic alloys; the use of e.g. ceramic materials may allow higher operating temperatures.

The power output of the engine depends heavily on the reciprocating speed. Unlike a conventional engine, the free-piston engine behaves similar to a mass-spring system, and the reciprocating speed is heavily influenced by the moving mass. Hence, the use of light-weight components in the piston assembly and load device is required for applications requiring a high engine power to weight ratio.

As with all heat engines, the minimising of heat transfer losses, leakage, and mechanical losses is of critical importance to obtain optimal fuel efficiency.

Finally, it is expected that the invention will be suitable for use in large plants in which several individual units provide the power outputs required in large-scale applications. Such a configuration allows significant operational benefits: individual units can be switched on or off according to the load demand of the plant; operation of several units with a common combustor is possible; operation of several units with a common recuperator is possible; and the positioning of the units and control of their operating speeds allow minimisation of system vibrations and noise.

With the use of an efficient thermodynamic cycle, a mechanically simple engine design, and electronic control of engine operation, a compact system with a fuel efficiency superior to that of prior art is presented. The system is suitable for energy conversion in a wide range of applications and sizes. The use of an open cycle with electronically controllable valves provides a solution to the piston motion control challenges in free-piston engine systems, which to date has hindered widespread commercial success of the free-piston engine concept. The invention is therefore suitable for applications which require a wide engine load range and have rapidly varying load demands.

It will be appreciated by persons skilled in the art that the above embodiments have been described by way of example only, and not in any limitative sense, and that various alterations and modifications are possible without departure from the scope of the invention as defined by the appended claims.

The invention claimed is:

1. A heat engine comprising:

a compression chamber;

a first positive displacement element reciprocable within said compression chamber;

an expansion chamber;

a second positive displacement element reciprocable within said expansion chamber;

wherein said first and second positive displacement elements are mechanically coupled to reciprocate in unison in a free-piston configuration;

at least one conduit for conducting a working fluid from said compression chamber to said expansion chamber;

at least one heating device for supplying heat to the working fluid in a heating section of said at least one conduit;

at least one first valve for controlling the flow of said working fluid into said compression chamber;

at least one second valve for controlling the flow of said working fluid from said compression chamber to said heating section;

at least one third valve for controlling the flow of said working fluid from said heating section to said expansion chamber;

at least one fourth valve for controlling the flow of said working fluid out of said expansion chamber;

a sensor adapted to output a signal corresponding to a position and/or velocity of the first and/or second positive displacement element; and a controller for continuously controlling said at least one third valve and/or said at least one fourth valve and/or the rate of supply of heat to the working fluid in accordance with the signal output by the sensor;

wherein the second positive displacement element divides the expansion chamber into two expansion subchambers, and wherein said at least one third valve is adapted to control the flow of said working fluid alternately to each expansion subchamber.

2. A heat engine according to claim 1, wherein the heat engine operates on an open cycle.

3. A heat engine according to claim 1, wherein said at least one heating device is a combustor.

4. A heat engine according to claim 3, wherein the controller is adapted to continuously control the supply of heat to the working fluid by outputting a signal for continuously controlling a rate of fuel injection to the combustor.

5. A heat engine according to claim 1, wherein the controller controls said at least one first valve, said at least one second valve, said at least one third valve and said at least one fourth valve.

6. A heat engine according to claim 1, wherein the first positive displacement element divides the compression chamber into two compression subchambers, and wherein said at least one first valve is adapted to control the flow of working fluid alternately to each compression subchamber.

7. A heat engine according to claim 1, further comprising an energy conversion device comprising at least one reciprocable element coupled for reciprocation with said first and second positive displacement elements.

8. A heat engine according to claim 7, wherein said energy conversion device is positioned between the compression chamber and the expansion chamber.

9. A heat engine according to claim 1, further comprising a heat exchanger for transferring heat from working fluid conducted from the expansion chamber to working fluid conducted from the compression chamber.

10. A heat engine according to claim 1, wherein the controller is adapted to adjust the timings of opening and/or closing said at least one third valve and/or said at least one fourth valve and/or to adjust the rate of input of heat to the working fluid to maintain stable engine operation, when the signal output by the sensor indicates a change in kinetic energy of the first and second positive displacement elements corresponding to a change in load force on the first and/or second positive displacement element.

11. A heat engine according to claim 1, wherein the controller is adapted to advance closure of said at least one fourth valve, when the signal output by the sensor indicates an increase in kinetic energy of the first and second positive displacement elements sufficient for the second positive displacement element to travel past a predefined end point.

12. A heat engine according to claim 1, wherein the controller is adapted to delay closure of the said at least one third valve, when the signal output by the sensor indicates a decrease in kinetic energy of the first and second positive displacement elements sufficient for the second positive displacement element to fail to reach a predefined end point.

13. A heat engine comprising:

a compression chamber;

a first positive displacement element reciprocable within said compression chamber;

an expansion chamber;

a second positive displacement element reciprocable within said expansion chamber;

wherein said first and second positive displacement elements are mechanically coupled to reciprocate in unison in a free-piston configuration;

at least one conduit for conducting a working fluid from said compression chamber to said expansion chamber;

at least one heating device for supplying heat to the working fluid in a heating section of said at least one conduit;

at least one first valve for controlling the flow of said working fluid into said compression chamber;

at least one second valve for controlling the flow of said working fluid from said compression chamber to said heating section;

at least one third valve for controlling the flow of said working fluid from said heating section to said expansion chamber;

at least one fourth valve for controlling the flow of said working fluid out of said expansion chamber;

a sensor adapted to output a signal corresponding to a position and/or velocity of the first and/or second positive displacement element;

a controller for continuously controlling said at least one third valve and/or said at least one fourth valve and/or the rate of supply of heat to the working fluid in accordance with the signal output by the sensor; and wherein the controller is adapted to advance closure of said at least one fourth valve, when the signal output by the sensor indicates an increase in kinetic energy of the first and second positive displacement elements sufficient for the second positive displacement element to travel past a predefined end point.

14. A heat engine according to claim 13, wherein the heat engine operates on an open cycle.

15. A heat engine according to claim 13, wherein said at least one heating device is a combustor.

16. A heat engine according to claim 15, wherein the controller is adapted to continuously control the supply of heat to the working fluid by outputting a signal for continuously controlling a rate of fuel injection to the combustor.

17. A heat engine according to claim 13, wherein the controller controls said at least one first valve, said at least one second valve, said at least one third valve and said at least one fourth valve.

18. A heat engine according to claim 13, further comprising an energy conversion device comprising at least one reciprocable element coupled for reciprocation with said first and second positive displacement elements.

19. A heat engine according to claim 13, wherein the controller is adapted to delay closure of the said at least one third valve, when the signal output by the sensor indicates a decrease in kinetic energy of the first and second positive displacement elements sufficient for the second positive displacement element to fail to reach a predefined end point.

* * * * *